US005641207A

United States Patent [19]

Shoffner

[11] Patent Number: 5,641,207

[45] Date of Patent: Jun. 24, 1997

[54] MINING MACHINE

[75] Inventor: Myron A. Shoffner, Worthington, Pa.

[73] Assignee: Ringgold Mines, Inc., Kittanning, Pa.

[21] Appl. No.: 515,319

[22] Filed: Aug. 15, 1995

[51] Int. Cl.[6] ..... E21D 9/08

[52] U.S. Cl. ..... 299/56

[58] Field of Search ..... 299/55, 56, 57, 299/58; 74/56, 55

[56] References Cited

U.S. PATENT DOCUMENTS

| | | | |
|---|---|---|---|
| 246,983 | 9/1881 | Stevenson . | |
| 421,999 | 2/1890 | Williams . | |
| 515,327 | 2/1894 | Eggert . | |
| 1,261,111 | 4/1918 | Fasey et al. . | |
| 1,339,276 | 5/1920 | Murphy . | |
| 1,630,976 | 5/1927 | Smith . | |
| 2,116,142 | 5/1938 | Chappell et al. | 74/56 |
| 2,441,596 | 5/1948 | Reitter | 74/57 |
| 2,451,374 | 10/1948 | Bell | 74/57 |
| 2,591,883 | 4/1952 | Shortland | 66/110 |
| 2,679,165 | 5/1954 | Montgomery | 74/57 |
| 2,872,825 | 2/1959 | Doren | 74/56 |
| 2,883,938 | 4/1959 | Shoffner | 103/157 |
| 2,959,967 | 11/1960 | Metzner | 74/56 |
| 3,203,737 | 8/1965 | Robbins et al. | 299/58 X |
| 3,204,567 | 9/1965 | Krawacki | 103/139 |
| 3,639,004 | 2/1972 | Lockwood et al. | 299/10 |
| 3,841,165 | 10/1974 | Benzing et al. | 74/56 |
| 4,040,682 | 8/1977 | Poulsen | 308/176 |
| 4,185,508 | 1/1980 | Hardt | 74/56 X |
| 4,225,124 | 9/1980 | Pollak | 269/234 |
| 4,371,211 | 2/1983 | Snyder | 299/11 |
| 4,553,612 | 11/1985 | Durham | 175/122 |
| 4,624,605 | 11/1986 | Akesaka | 299/56 X |
| 4,637,657 | 1/1987 | Snyder | 299/31 |
| 4,717,119 | 1/1988 | Trin | 251/144 |
| 4,790,395 | 12/1988 | Gack et al. | 299/56 X |
| 5,032,039 | 7/1991 | Hagimoto et al. | 405/141 |
| 5,228,752 | 7/1993 | Hartwig | 299/31 |
| 5,333,936 | 8/1994 | Zitz | 299/64 |

*Primary Examiner*—William P. Neuder
*Attorney, Agent, or Firm*—Webb Ziesenheim Bruening Logsdon Orkin & Hanson, P.C.

[57] ABSTRACT

A boring machine for use in mining having a base, a hydraulic motor and a cutting member. The hydraulic motor includes a pair of hydraulically activated oscillating drive units, a cylindrically shaped rotating shell, a cylindrically shaped stationary shell and a pair of cam units. The oscillating drive units are contained within the stationary shell, and extend along the longitudinal axis, each of the drive units has an arm that is adapted to extend along the longitudinal axis and a cam driver secured to the arm. The stationary shell is rotatably coupled to the rotating shell and has elongated slots adapted to coact with the cam drivers so as to longitudinally guide the cam drivers and prevent the cam drivers from rotating about the longitudinal axis. The cam units are secured to an inner surface of the rotating shell. Each cam unit is adapted to coact with a respective drive unit and includes a plurality of cams circumferentially spaced apart from each other and define cam driver paths, wherein respective ones of the cam drivers are received within the cam drive paths. The cam drive paths are arranged so that when one of the drive unit arms is in an extending mode, the other drive unit arm is in a retracting mode. The cutting member is secured to the rotating shell, whereby oscillation of the arms along the longitudinal axis causes the cam drivers to coact with respective ones of said cams along the cam drive paths causing said rotating shell and said cutting member to rotate.

28 Claims, 5 Drawing Sheets

MINING MACHINE

BACKGROUND OF THE INVENTION

1) Field of the Invention

This invention relates generally to mining machines and, more particularly, to mining machines adapted to bore into relatively low coal seams.

2) Description of the Prior Art

Generally, two types of mining procedures are used to extract coal from coal seams, underground mining and above ground mining. In either case, the coal seam is usually sandwiched between layers of rock. In the case of underground mining, various methods can be used to extract the coal, such as explosives or long wall and short wall mining apparatuses, that are well known in the art. Above ground coal extractions can be accomplished through the use of large cranes or other types of extraction devices, which are also well known in the art.

Generally speaking, the higher the coal seam, the more profitably it can be extracted. In many areas throughout the United States, the higher coal seams have been extensively mined. However, many of the lower coal seams remain intact because it was not economically feasible to mine them. By "low coal seam", it is meant coal seams which are approximately thirty inches thick or less. Devices using the present gear reduction technology cannot effectively and efficiently mine these seams. Therefore, it is an object of my invention to profitably extract coal from low coal seams.

Further, in many instances, coal extracted from low coal seams under the present technology includes substantial quantities of rock. The extracted coal must then be cleaned and prepared. The more rock and other non-coal products found in the extracted coal, the more the coal must be processed. This results in substantial amounts of waste water and tailings and has a negative impact on the environment, as well as the yield, which directly affects the profitability of the coal mining operation. Present continuous mining excessive amounts of "fines" (small particles of coal), which negatively affects the price of the mined coal. Therefore, it is also an object of my invention to extract coal having a minimal impact on the environment and maximum profit.

SUMMARY OF THE INVENTION

My invention is a boring machine having a base, a motor secured to the base and a boring element. The motor includes a pair of oscillating drive units, a cylindrically shaped rotating shell and a pair of drive units. The oscillating drive units extend along a longitudinal axis. Each of the drive units has an arm that is adapted to extend along the longitudinal axis, and has a cam driver secured to the arm. The rotating shell is coaxial with the longitudinal axis. The pair of cam units are secured to a surface for the rotating shell. Each cam unit is adapted to coact with a respective drive unit and includes a plurality of cams circumferentially spaced apart from each other and defines a cam drive path, wherein respective cam drivers are received within the cam drive paths. The cam drive paths are arranged so that when one of the drive unit arms is in an extending mode, the other arm is in a retracting mode. The cutting member is secured to the rotating shell, whereby oscillation of the arms about the longitudinal axis causes the cam drivers to coact with respective cams along the cam drive paths causing the rotating shell and cutting member to rotate.

A stationary shell can be provided that is rotatably coupled to the rotating shell. The stationary shell includes elongated slots adapted to coact with the cam drivers so as to guide the cam drivers in the longitudinal direction and prevent the cam drivers from rotating about the longitudinal axis. The stationary shell is contained within the rotating shell and is secured to the rotating shell through bearings.

The boring machine includes a conveyor to move the bored products and an arrangement to move the boring machine within a bore hole. A device to adjust the height of the cutting member is also provided.

Each of the cams includes two angled sides that converge to a first surface and diverge to a second surface. The angled surfaces extend along the longitudinal axis. The first surface is shorter than the second surface. Adjacent cams alternate their orientation so that first surfaces and second surfaces are positioned adjacent each other about the circumference of the rotating shell.

DESCRIPTION OF THE PREFERRED EMBODIMENT

Figure 1:
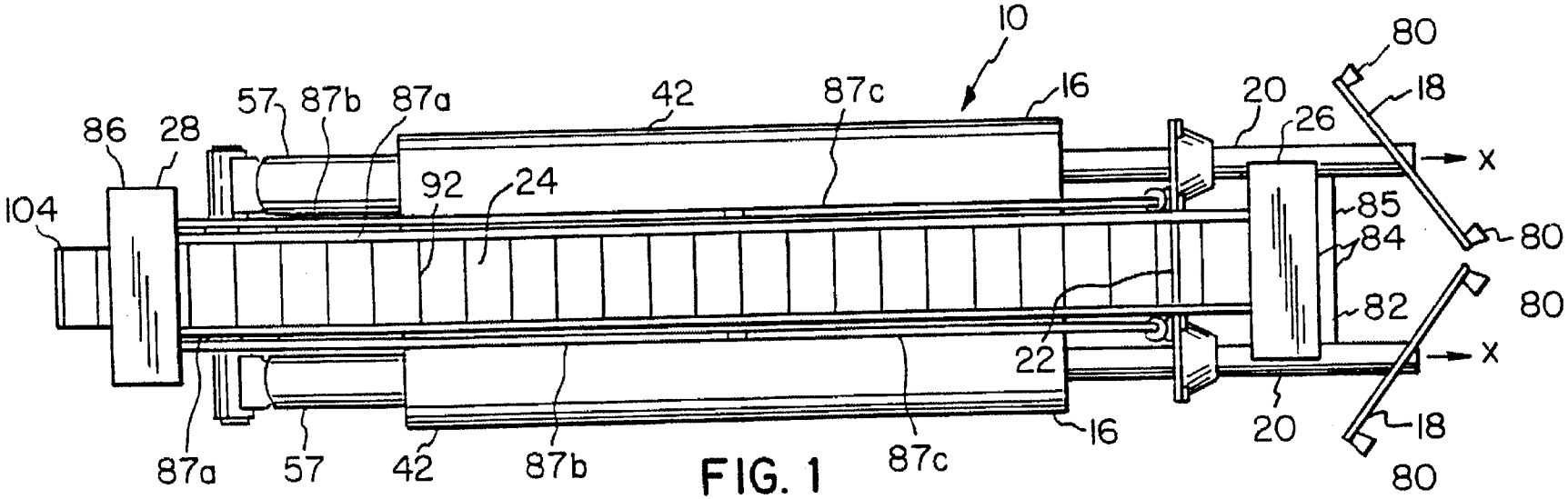
FIG. 1 is a top view of a mining machine made in accordance with the present invention.
Figure 2:
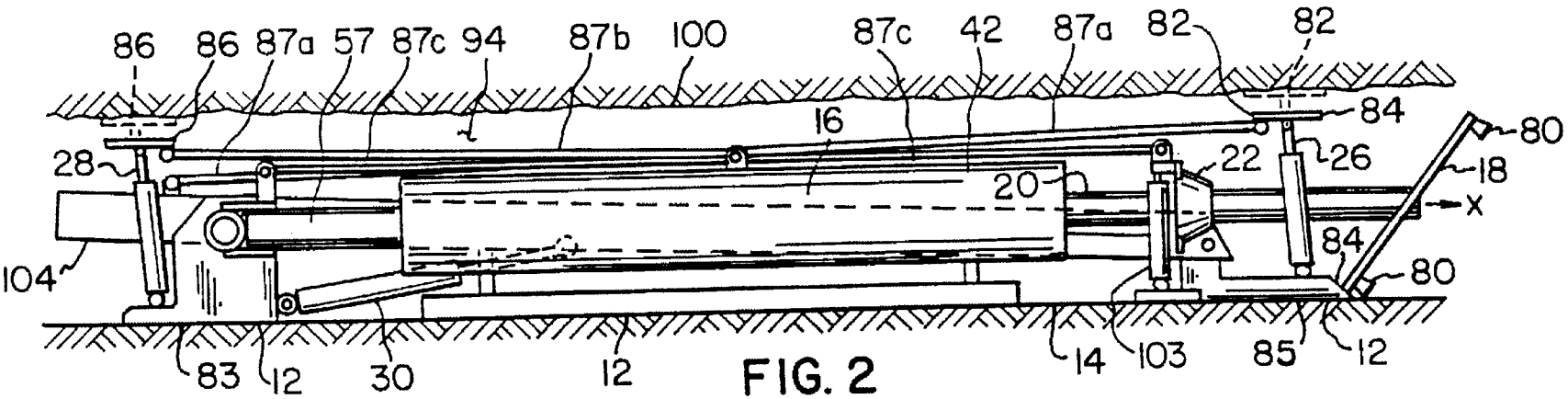
FIG. 2 is a side view of the mining machine shown in FIG. 1 in a bore hole.

FIGS. 1 and 2 of the drawings, generally show a boring or mining machine 10 made in accordance with the present invention. Mining machine 10 includes a frame or base 12 adapted to be supported by a mine floor 14. Two hydraulic motors 16 are positioned in side-by-side relationship and are secured to base 12. Each motor is adapted to rotate a cutting member 18 through a drive shaft 20. Drive shafts 20 pass through spherical bearings provided in a lifting member 22, which is adapted to raise and lower cutting members 18, as well as support drive shafts 20. A conveyor 24 is positioned between hydraulic motor 16 and extends rearwardly of shafts 20. Conveyor 24 is supported by the base 12. A forward drive unit 26, a rearward drive unit 28 and horizontal drive units 30 are provided to assist in moving the mining machine 10 and will be discussed in detail below.

Figure 3:
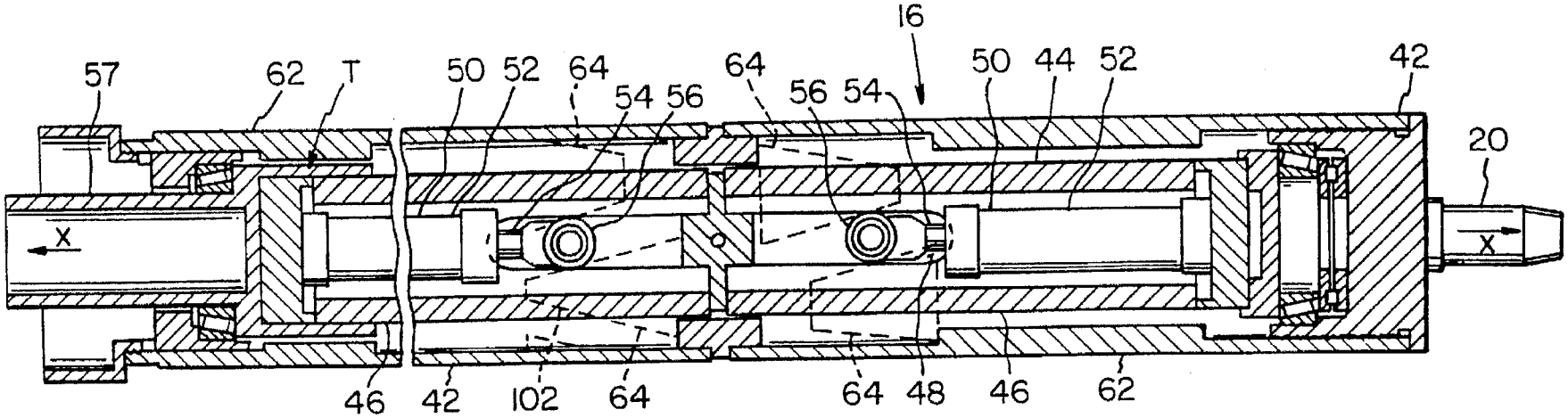
FIG. 3 is a partial sectional view of a motor of the mining machine shown in FIG. 1.

Referring to FIGS. 3–8, particularly FIG. 3, of the drawings, each motor 16 includes a rotating shell 42 and a stationary shell 44. The stationary shell 44 is rotatably coupled to the rotating shell 42 through roller bearings positioned at opposite ends of the stationary shell 44. In this manner, the rotating shell 42 can rotate about the longitudinal axis relative to stationary shell 44. The shaft 20 is attached to a front plate secured to a forward end of the rotating shell 42. A thrust bearing is provided between the front plate and a forward end of the stationary shell 44.

Figure 5:
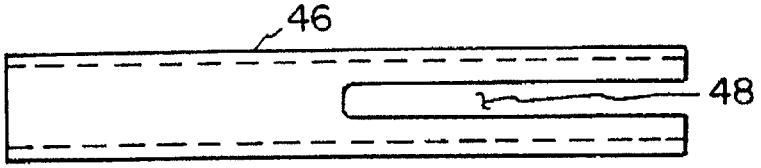
FIG. 5 is a side view of another stationary shell segment of the mining machine.
Figure 4:
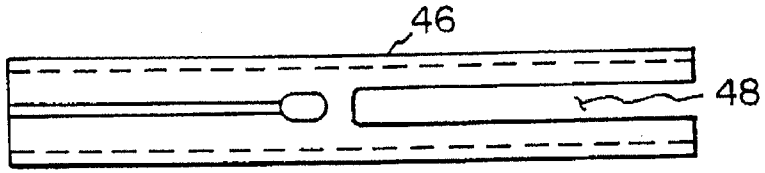
FIG. 4 is a side view of a stationary shell segment of the mining machine.
Figure 6:
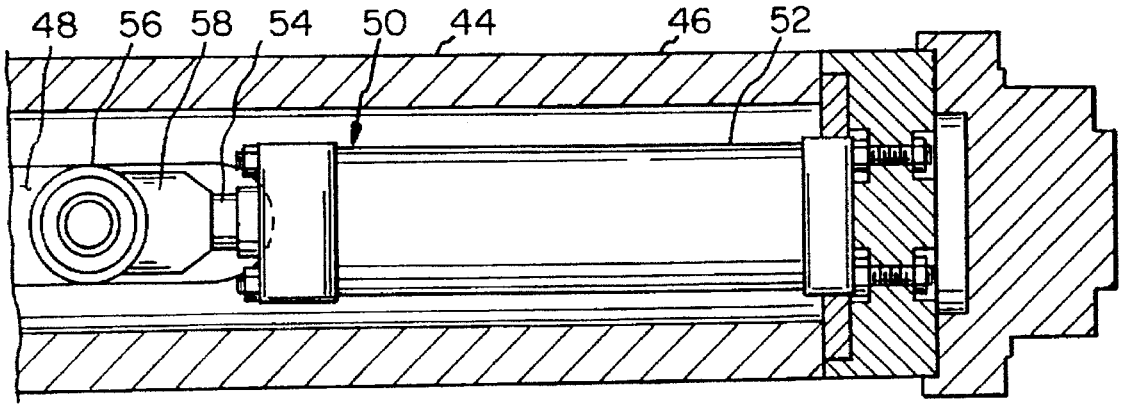
FIG. 6 is a partial cross-sectional view of a portion of the stationary shell and a hydraulic drive unit.
Figure 7A:
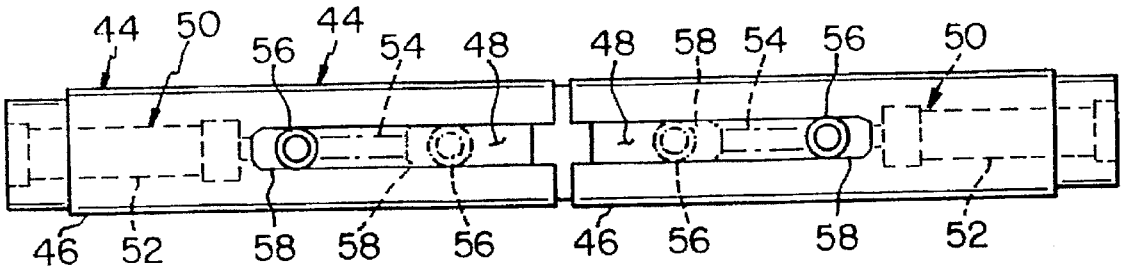
FIG. 7*a* is a side view of the stationary shell and drive unit.
Figure 7B:
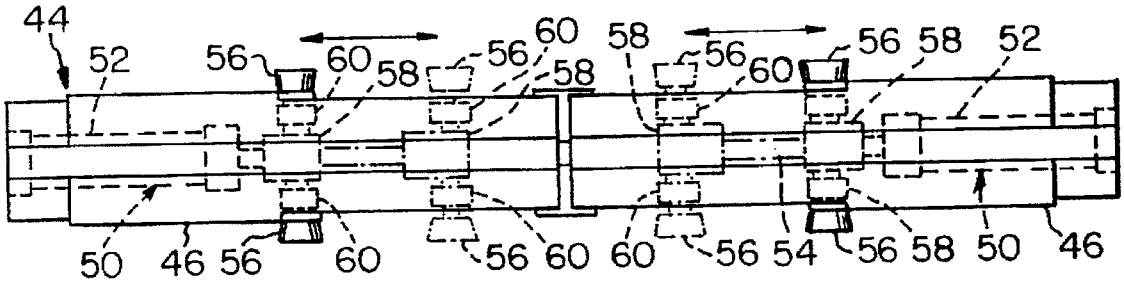
FIG. 7*b* is a top view of the stationary shell and drive unit.
Figure 10A:
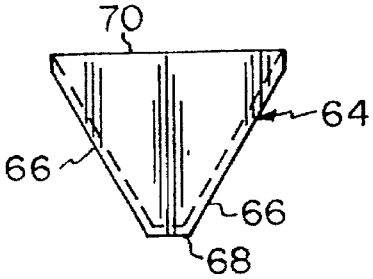
FIG. 10*a* is a top view of a cam of the present invention.
Figure 10B:
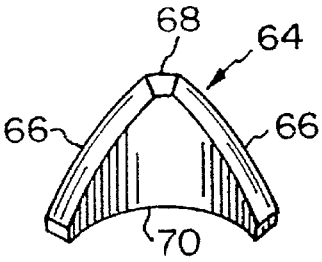
FIG. 10*b* is a top perspective view of the cam shown in FIG. 10*a;*
Figure 10C:
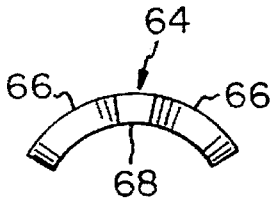
FIG. 10*c* is a front view of the cam shown in FIG. 10*a;*

Stationary shell 44 includes two hollow cylindrical members 46, as shown in FIGS. 3, 4, 5 and **7*a*–7*b* of the drawings. Each cylindrical member 46 includes oppositely disposed open ended guide slots 48. The cylindrical members 46 are joined together at their ends so that slots 48 face each other. Two hydraulic drive units 50 are secured to each stationary shell 44. Each hydraulic drive unit 50 includes a cylinder 52, a longitudinally extendable piston 54 received by cylinder 52 and tapered rollers 56 secured to a distal end of piston 54. Supplying pressurized hydraulic fluid to cylinder 52 causes the piston 54 to extend along a longitudinal axis "X". Cylinders 52 are secured to respective end plates of stationary shell 44 so that pistons 54 face each other. A rearward shaft 57 is secured to the rearward one of the cylindrical members 46** and extends rearwardly therefrom.

Figure 8:
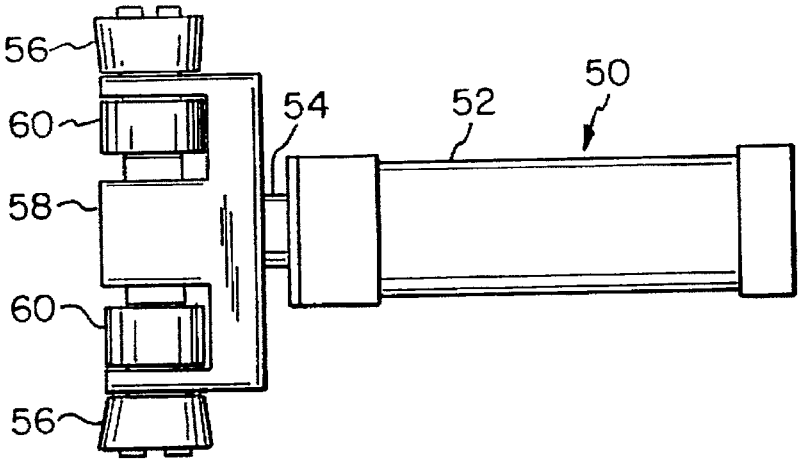
FIG. 8 is a top view of a hydraulic drive unit.

As shown in FIG. 8 of the drawings, a carriage 58 is secured to the distal end of piston 54. The tapered rollers 56 are rotatably secured to the carriage 58 by a shaft which passes through carriage lugs. A set of cylindrical rollers 60 are also rotatably secured to the carriage shaft and are positioned between rollers 56. Rollers 60 are slidably received within guide slots 48, as shown in FIG. **7*b*** of the drawings.

Figure 9:
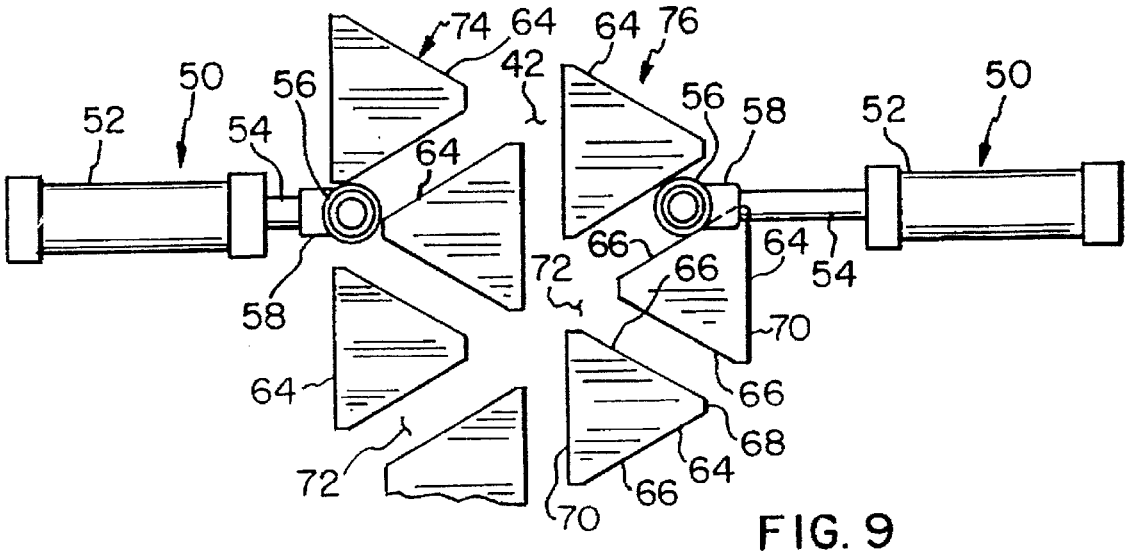
FIG. 9 is a linear representation of two hydraulic drive units engaged with cams of the motor.

Referring now to FIGS. 3, 9 and **10*a*–10*c* of the drawings, rotating shell 42 is made up of two segments 62 connected by a coupling. Shaft 57 is also secured to the rearward segment 62 through a bearing arrangement so that the rearward segment 62 can rotate relative to shaft 57. Four curved cams 64 are equally spaced, i.e., at ninety degrees, about an inner surface of each rotating shell segment 62. As shown in FIG. 9 of the drawings, which is a partial linear representation of the cams 64 and hydraulic drive units 50, cams 64 have two opposite angled sides 66, a top 68 and a base 70, where the top 68 is shorter than base 70. Sides 66 converge toward top 68. Adjacent cams 64 of each segment 62 are inverted and offset along the longitudinal axis so as to define a passageway 72 between sides 66 and top 68. Surfaces of the cam sides 66 and top 68 are tapered and coact with the tapered rollers 56, which are received within passageway 72. As stated previously, the four cams 64 on each rotating shell segment 62 are positioned ninety degrees apart about the inner circumference of the rotating shell 42 forming cam sets 74 and 76**, which are spaced apart on opposite sides of a plane normal to the longitudinal axis "X" and offset forty-five degrees from each other.

Figure 11:
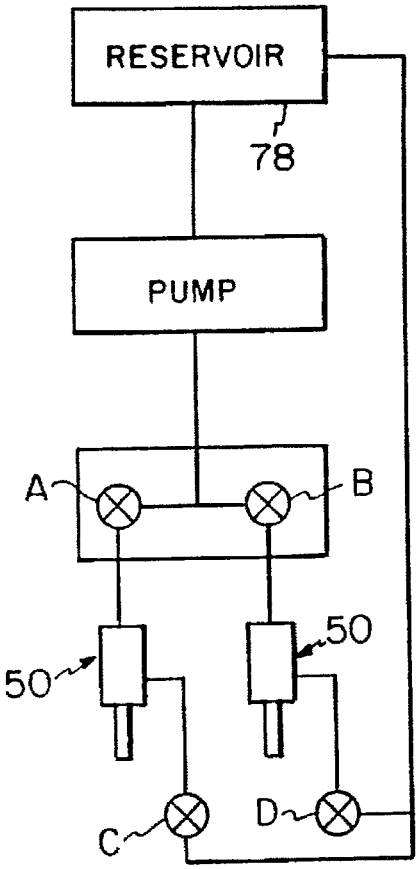
FIG. 11 is a schematic representation of a hydraulic motor circuit.

Operation of the motor will now be explained. Initially, pressurized hydraulic fluid is supplied by a pump, as schematically shown in FIG. 11 of the drawings, to only one of the hydraulic units 50. This causes piston 54 to extend outwardly. Rollers 60 are guided by the surfaces defining stationary shell slots 48 and tapered rollers 56 coact with sides 66 of adjacent cams 64, while moving in passageway 72. Piston 54 continues to extend outwardly until rollers 56 are adjacent cam top 68, thereby causing the rotating shell 42 to rotate about the longitudinal axis "X". During this time, the other hydraulic drive unit 50 is fluidly coupled to a low pressure hydraulic fluid reservoir 78, as schematically shown in FIG. 11 of the drawings, and its respective piston 54 is urged from an extended position to a retracted position by its respective rollers 56 coacting with cam angled sides 66.

Then, through appropriate valving, the initially pressurized hydraulic unit 50 is fluidly coupled to the reservoir 78, instead of to the pump, through appropriate valving (not shown). The other hydraulic drive unit 50 is supplied with pressurized hydraulic fluid from the pump through appropriate valving instead of to the reservoir causing the rotating shell 42 to continue to rotate about the longitudinal axis "X" relative to stationary shell 42. As one of the pistons 54 extends outwardly, the other piston coacts with adjacent angled sides 66 causing it to retract and forcing the hydraulic fluid contained within the cylinder 52 into the reservoir 78 through appropriate hosing. Although not shown, appropriate hosing and valves are coupled to the hydraulic drive units 50 and pass through a rearward section of the stationary shell 44. The above process is continually repeated, causing the drive shaft 20 to rotate about the longitudinal axis "X", which is secured to the rotating shell 42 while stationary shell 44 remains stationary.

Most preferably, four spaced cams 64 are provided as shown. However, two spaced cams or eight spaced cams can be provided. Varying the number of cams and the length of the cams results in varying the output torque and speed of shaft 20.

A timing assembly "T" is provided on each motor 16 to control the activation and deactivation of the hydraulic units. The timing assembly "T" provided includes eight inductive switches equally spaced around the outer surface of the stationary shell 44 near its rearward end and two targets spaced one hundred eighty degrees apart and to the rotating shell 42. The targets and inductive switches coact with each other in a manner well known to control valving A, B, C and D for directing the hydraulic fluid from a hydraulic pump to the respective drive unit 50 and return to the hydraulic fluid reservoir 78. The following table shows the angular position of the rotating shell 42 relative to a fixed reference point and the position of the valves, i.e., opened or closed, as the shell 44 rotates about the longitudinal axis "X":

| | VALVE POSITIONS | | | |
|---|---|---|---|---|
| Angular Position of Rotating Shell 44 | A | B | C | D |
| 0° | Opened | Closed | Opened | Closed |
| 45° | Closed | Opened | Closed | Opened |
| 90° | Opened | Closed | Opened | Closed |
| 135° | Closed | Opened | Closed | Opened |
| 180° | Opened | Closed | Opened | Closed |
| 225° | Closed | Opened | Closed | Opened |
| 270° | Opened | Closed | Opened | Closed |
| 315° | Closed | Opened | Closed | Opened |
| 360° | Opened | Closed | Opened | Closed |

Figure 12:
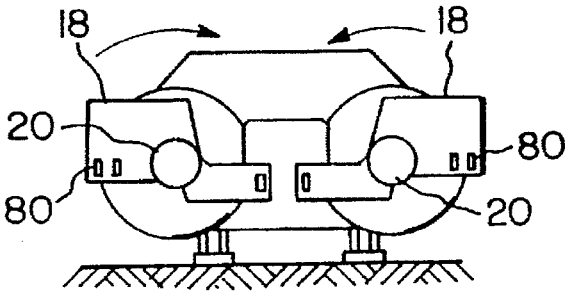
FIG. 12 is a front view of the mining machine shown in FIGS. 1 and 2.

The synchronization of the hydraulic drive units 50 is such that the shafts 20 of each motor 16 rotates in opposite directions, as shown in FIG. 12. This, in turn, causes cutting members 18 and cutters 80 to rotate about respective longitudinal axes. The cutters 80 are standard mining bits well known in the art.

Each shaft 57 is pivotally secured to a rear support 83 of base 12. Lifting member 22, which supports shafts 20, is supported on the mine floor through hydraulic piston/cylinder arrangements as shown in FIGS. 1 and 2 of the drawings, to which the cylinder portions are connected to support plates that form a portion of base 12.

The forward drive unit 26 is coupled to the conveyor 24 and includes two hydraulic units or jacks positioned on opposite sides of the conveyor 24. Each of the forward drive hydraulic units includes a cylinder that receives an extendable piston. Forward lifting plates 82 are secured to the distal end of the forward drive unit piston and a support plate 85 is secured to the base of the cylinders. Support plate 85 is secured to the conveyor 24 and forms a portion of the frame 12. Sharp edges 84 are defined on forward edges of the lifting plate 82 and support plate 85. Appropriate hosing and valving are provided to supply and remove hydraulic fluid from the cylinders of the forward drive unit 26.

The rearward drive unit 28 is coupled to the frame 12 through the two horizontal drive units 30 each for which is a horizontally extending double acting hydraulic unit or jack positioned on opposite sides of the conveyor 24. Each unit 30 includes a cylinder and a piston. One end of each double acting hydraulic units 30 is secured to rear support 83 and the other end of each unit 30 is pivotally connected to the conveyor 24.

The rearward drive unit 28 includes two hydraulic units or jacks positioned on opposite sides of the conveyor 24. Each of the rearward drive unit hydraulic jacks is similar to the forward drive unit hydraulic jacks. A lifting plate 86 is secured to the distal end of the piston and the base of the cylinder is secured to the rear support 83. Appropriate hosing and valving are provided for both the horizontal drive units and the rearward drive unit jacks. Two braces 87*a* are pivotally secured to opposite sides of upper lifting plate 82 and opposite sides of a conveyor segment 104, which is discussed hereinafter. Braces 87*b* are pivotally secured at one end to opposite sides of upper lifting plate 86. The other ends of braces 87*b* are pivotally secured to brackets, which are attached to respective braces 87*c*. Opposite ends of each brace 87*c* are secured to rear support 83 and to lifting member 22 so that braces 87*c* are positioned on opposite sides of the conveyor 24.

Figure 14:
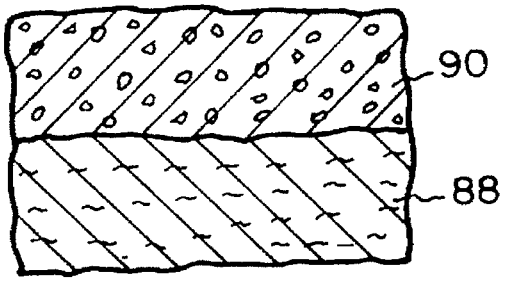
FIG. 14 is a cross-sectional view of a coal seam.
Figure 15:
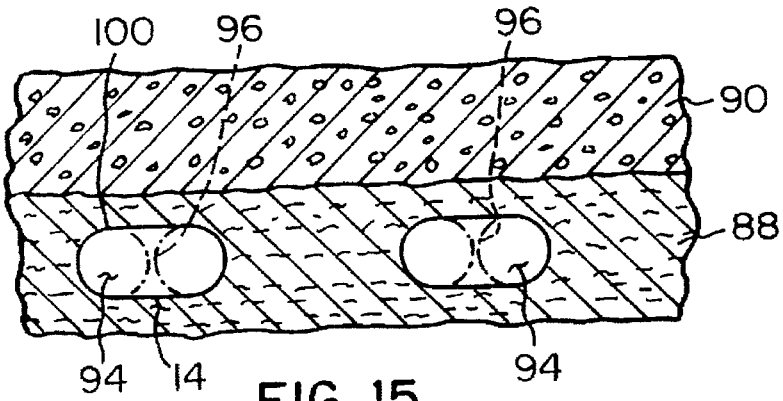
FIG. 15 is a cross-sectional view of bore holes made by the mining machine of the present invention.

The operation of the mining machine 10 will now be discussed. First, the cutters 80 are positioned adjacent a low coal seam 88. Typically, a rock strata 90 will be positioned thereabove, as shown in FIG. 14. The hydraulic pump is then activated. The pump should be electrically operated and supplied with electricity from an outside source. The hydraulic drive units 50 are then activated, as previously discussed, causing cutting members 18 to rotate about their respective longitudinal axes "X". The frame 12 is pushed by an appropriate vehicle, such as a bulldozer, into the seam so that cutters 80 engage with the coal seam causing coal to break into small pieces and fall downwardly. The coal pieces are directed onto the conveyor 24 by the rotating cutting members 18. The conveyor 24 moves the coal pieces rearwardly toward the entrance of the bore hole formed by the cutting members 18. The conveyor 24 includes a plurality of upwardly extending plates 92 attached to an endless chain and sprocket arrangement driven by an electric motor. The frame 12 is pushed into the coal seam until the rearward drive unit 28 is contained within the bore hole 94 made by the cutting members 18. A small pillar of coal 96 may be present adjacent cutting members 18, as shown in phantom in FIG. 15. The forward edges of the forward lifting plates 82 cut into the pillars, thereby making an oblong bore hole, as shown in FIG. 15.

Figure 13:
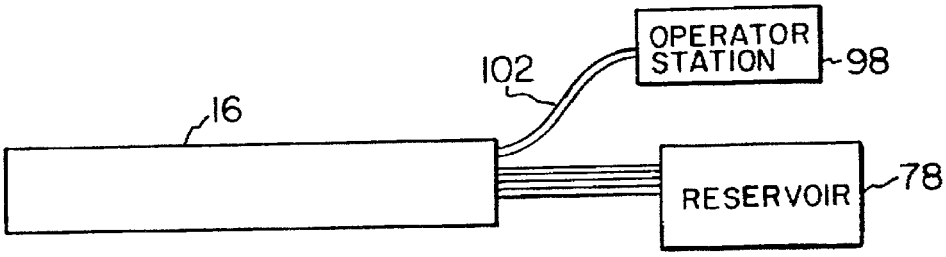
FIG. 13 is a schematic representation of the motor, control station and reservoir of the present invention.

Once the rearward drive unit 28 is contained within the bore hole 94, then the mining machine can be remotely operated from the control station 98, as shown in FIG. 13 of the drawings. Initially, the forward drive unit 26 is deactivated so that the forward drive unit pistons are in an unpressurized state so that either the upper forward lifting plate 82 is not engaged with the bore hole roof 100 or slightly abuts against the roof. Alternatively, a spring can be provided within each of forward drive cylinders so that the upper forward lifting plate always contacts the bore hole roof in an unpressurized state. Preferably, the edges 84 of the upper forward lifting plate 82 should always contact the roof so that they can cut into the pillars as the conveyor 24 moves forwardly. The rearward drive unit 28 is activated so that the rearward jacks are supplied pressurized hydraulic fluid causing the respective pistons to extend and engage the rearward lifting plates 86 with the roof and floor 14 of the bore hole 94. Pressurized hydraulic fluid is then provided to the horizontal drive unit 30 causing the respective pistons to extend in the forwardly direction, thereby forcing the conveyor 24 and the lifting member 22 forwardly and the lifting plates 82 upwardly and forwardly, as shown in phantom in FIG. 2 of the drawings. Preferably, the horizontal drive unit 30 is activated after the forward drive unit 26 is deactivated and the rearward drive unit 28 is activated. Preferably, there is a two-tenths of a second delay before the horizontal drive unit 30 is activated to move the pistons in the forwardly direction. The lifting member spherical bearings slide longitudinally over the shafts 20. The forward drive unit 26 is then activated and the respective jacks are supplied with pressurized hydraulic fluid causing the pistons to extend engaging forward lifting plates 82 with the roof and floor 14 of the bore hole. The rearward drive unit 28 is deactivated causing the upper rearward lifting plate 86 to retract away from the bore hole roof 100. The horizontal drive unit jacks 30 are supplied with pressurized fluid so as to force the cylinders forward and causing the piston arms to retract within the cylinders, thereby pulling rear support 83, motor 16 in the forward direction. The rearward drive unit jacks 30 are activated in this manner after the rearward drive unit 28 is deactivated and the forward drive unit 26 is deactivated. This causes the cutters 80 to be pushed forwardly into the coal seam with the shafts 20 passing slidably through the spherical bearings of the lifting member 22. Then the rearward drive unit 28 is again activated and the forward drive unit 26 is deactivated and the above process is repeated, thereby moving the mining machine forward.

The above process can be reversed to remove the mining machine 10 from the bore hole 94 or the retrieval cable 102 can be used to pull the mining machine 10 from the bore hole. Further, the mining machine 10 can be directed left or right by only activating one jack of the horizontal drive unit 30. The elevation of the mining machine 10 in the seam can be varied by manipulation in the vertical direction of the lifting member 22.

The cutting members 18 can be raised by activation of a hydraulic piston/cylinder arrangement 103 of lifting member 22 which, in turn, raises or lowers respective drive shafts 20. This permits greater flexibility of the mining machine 10 to mine seams having a height greater than the diameter of the cutting member 18.

Microphone or vibration sensors can be provided near the cutting members, so that the operator in the operator station 98 can "hear" if the cutters 80 are cutting into coal or rock. As is well known in the art, the vibration and sound of the cutters vary whether the cutters 80 are cutting rock or coal. This will permit adjustments to the cutting members 18, i.e., lowering or raising the cutting members 18 or turning the mining machine 10 left or right, so that the mining machine 10 is extracting only coal and not coal and rock.

Finally, additional conveyor sections or segments 104 can be added as the mining machine 10 moves into the bore hole 94. It is believed that the mining machine 10 (which is approximately sixty five inches wide and thirty five inches high) can bore a hole of varying length into a seam depending on the life of the cutting members and economic viability of continued coal extraction of the seam. The mining machine 10 can be removed from the bore hole and placed adjacent thereto to form another hole. However, a pillar, as shown in FIG. 15, should be positioned between the holes to prevent the holes from caving in. Preferably, the cutting members rotate at 6–20 RPM (revolutions per minute). This will result in a superior size coal and minimize fines. Hence, the extracted coal can be sold for a premium price and need no processing. Further, the mining machine 10 can be operated by one miner in the operator station 98, as shown in FIG. 13 of the drawings and a second miner positioning the conveyors 24. Furthermore, since the motors 16 do not require reduction gears, a powerful, yet compact, device can easily be built having a height less than twenty-four inches. This permits economical retrieval of the lowest seam coal possible.

It is believed that the mining machine 10 can be adapted to bore larger holes for tunnels and the hydraulic motor can be used in any arrangement where linear motion needs to be converted into rotational motion for high torque/low speed applications.

In the foregoing specification, I have described the presently preferred embodiment of my invention and method of practicing the invention. However, it will be understood that the invention can be otherwise embodied and practiced within the scope of the appended claims.

I claim:

1. A boring machine comprising:

a base;

a motor secured to said base, said motor comprising:

a pair of oscillating drive units extending along a longitudinal axis, each of said drive units having an arm that is adapted to extend along the longitudinal axis and a cam driver secured to said arm, a cylindrically shaped rotating shell, said rotating shell coaxial with the longitudinal axis, and a pair of cam units secured to a surface of said rotating shell, each cam unit adapted to coact with a respective drive unit and includes a plurality of cams circumferentially spaced apart from each other and defining a cam drive path, wherein respective ones of said cam drivers are received within said cam drive paths, said cam drive paths arranged so that when one of said drive unit arms is in an extending mode, the other of said arms is in a retracting mode; and a cutting member secured to said rotating shell, whereby oscillation of said arms along the longitudinal axis causes said cam drivers to coact with respective ones of said cams along said cam drive paths causing said rotating shell and cutting member to rotate.

2. A boring machine as claimed in claim 1, wherein said arms face each other.

3. A boring machine as claimed in claim 1, wherein said cam path is defined on an inner surface of said shell.

4. A boring machine as claimed in claim 1, wherein said cam units include a plurality of cams, each of said cams includes angled sides.

5. A boring machine as claimed in claim 4, wherein said angled sides of adjacent cams define a portion of the cam path.

6. A boring machine as claimed in claim 4, wherein each of said cams includes two angled sides that converge to a first surface, said two angled surfaces diverge to a second surface, said first surface being shorter than said second surface adjacent ones of said cams alternating their orientation so that first surfaces and second surfaces are positioned adjacent each other about the circumference of the rotating shell and said angled surfaces extend along the longitudinal axis.

7. A boring machine as claimed in claim 6, wherein a plane normal to the longitudinal axis passing through said shell defines a first section on one side of the plane and a second section on the other side of said plane, said first section contains said first cam unit and said second section containing said second cam unit, wherein said first cam unit being offset circumferentially from said second cam unit.

8. A boring machine as claimed in claim 6, wherein adjacent cams are offset about the longitudinal axis.

9. A boring machine as claimed in claim 1, wherein each of said drive units includes a fluidly controlled unit including a piston slidably received within a chamber whereby pressurization of fluid contained within said chamber causes said piston to extend along the longitudinal axis, said cam driver secured to said piston.

10. A boring machine as claimed in claim 9, wherein said drive units are hydraulically driven units, said boring machine further comprising a hydraulic pump fluidly coupled to said cylinders for supplying pressurized fluid to said cylinders, so as to cause said pistons to extend along the longitudinal axis.

11. A boring machine as claimed in claim 10, wherein a two positioned valve is fluidly coupled to said pump and said cylinders, wherein when said valve is in a first position, said pump is fluidly coupled to one of said cylinders and when said valve is in a second position, said pump is fluidly coupled to the other of said cylinders.

12. A boring machine as claimed in claim 11, wherein said valve position is controlled by a rotational position of said shell about said longitudinal axis.

13. A boring machine as claimed in claim 11, wherein when said valve is in said first position, one of said cylinders is fluidly coupled to said pump and supplied with pressurized fluid causing corresponding piston to extend and said other cylinder is fluidly coupled to a hydraulic fluid reservoir and said corresponding piston is retracted by coacting with said cam.

14. A boring machine as claimed in claim 13, wherein when said valve is in said second position, said other one of said cylinders is fluidly coupled to said pump causing said corresponding piston to extend and said one of said cylinders is coupled to said hydraulic fluid reservoir and said corresponding piston is retracted by coacting with said respective cam unit.

15. A boring machine as claimed in claim 1 further comprising a boring element secured to said shell, said boring element adapted to rotate about the longitudinal axis.

16. A boring machine as claimed in claim 15 further comprising a conveyor secured to said base and having an end positioned adjacent said boring element.

17. A boring machine as claimed in claim 16, wherein said conveyor comprises a frame and a plurality of spaced plates movably secured to said frame so as to move coal in a rearwardly direction away from said boring element.

18. A boring machine as claimed in claim 17, wherein said conveyor is segmented.

19. A boring machine as claimed in claim 15 further comprising a second motor similar to said motor, secured to said base and spaced apart from said motor in side-by-side relationship, wherein a second boring element is secured to said second motor shell.

20. A boring machine as claimed in claim 15 further comprising means for adjusting the height of said cutting member.

21. A boring machine as claimed in claim 20, wherein said means for adjusting the height of said cutting member includes a hydraulically operated extendable and retractable element coupled to said boring element and adapted to vertically position said boring element.

22. A boring machine as claimed in claim 22 further comprising means for horizontally moving said boring machine.

23. A boring machine as claimed in claim 1 further comprising a stationary shell rotatably coupled to said rotating shell, said stationary shell having an elongated slot adapted to coact with said cam drivers so as to longitudinally guide said cam drivers and prevent said cam drivers from rotating about the longitudinal axis.

24. A boring machine as claimed in claim 23, wherein said stationary shell is contained within said rotating shell, said stationary shell is secured to said rotating shell through a bearing arrangement.

25. A boring machine as claimed in claim 23, wherein each of said drive units includes a carriage secured to said respective arms and a roller is provided to be slidably received within said stationary shell elongated slot.

26. A boring machine as claimed in claim 23, wherein said cam driver is a roller.

27. A boring machine as claimed in claim 26, wherein said roller has a tapered surface.

28. A method for boring a hole comprising the steps of:

a) positioning a pair of longitudinally extending drive units along a longitudinal axis, said pair of drive units including extendable and retractable pistons facing each other, wherein said pistons are fluidly controlled;

b) alternating the extension of each of said pistons;

c) coacting said pistons with a set of cams secured to a tubular shaped rotating driven unit, wherein said drive units are contained within said driven unit;

d) rotating said driven unit about the longitudinal axis;

e) rotating a boring member by said driven unit; and f) boring a hole with said boring member.

* * * * *

UNITED STATES PATENT AND TRADEMARK OFFICE

CERTIFICATE OF CORRECTION

PATENT NO. : 5,641,207

DATED : June 24, 1997

INVENTOR(S) : Myron A. Shoffner

It is certified that error appears in the above-indentified patent and that said Letters Patent is hereby corrected as shown below:

Column 1 Line 40 after "coal)" delete --, which--.

Column 2 Line 57 after "drawings" delete --comma (,)--.

Column 4 Line 63 "rotates" should read --rotate--.

Column 5 Line 19 "each for which is" should read --each of which has--.

Column 5 Line 23 "units" should read --unit--.

Column 8 Claim 13 Line 43 after "causing" insert --a--.

Column 9 Claim 22 Line 12 "as claimed in claim 22" should read --as claimed in claim 20--.

Signed and Sealed this

Twenty-first Day of October 1997

*Attest:*

*Attesting Officer*

BRUCE LEHMAN

*Commissioner of Patents and Trademarks*